US006715392B2

(12) United States Patent
Zscheile

(10) Patent No.: US 6,715,392 B2
(45) Date of Patent: Apr. 6, 2004

(54) MACHINE FOR CUTTING STACKED SHEET MATERIAL AND THE LIKE

(75) Inventor: Thomas Zscheile, Frankfurt/Main (DE)

(73) Assignee: Adolf Mohr Maschinenfabrik GmbH & Co. KG, Hofheim (DE)

( * ) Notice: Subject to any disclaimer, the term of this patent is extended or adjusted under 35 U.S.C. 154(b) by 0 days.

(21) Appl. No.: 09/904,377

(22) Filed: Jul. 12, 2001

(65) Prior Publication Data

US 2002/0020274 A1 Feb. 21, 2002

(30) Foreign Application Priority Data

Jul. 14, 2000 (EP) ..... 00115271

(51) Int. Cl.[7] ..... A26D 7/26; A26D 1/04
(52) U.S. Cl. ..... 83/638; 83/699.41
(58) Field of Search ..... 83/638, 698.31, 83/694, 699.11, 699.41, 699.31, 697, 556, 93

(56) References Cited

U.S. PATENT DOCUMENTS 4,850,257 A * 7/1989 Mohr ..... 414/788
5,150,647 A * 9/1992 Mohr ..... 100/210
5,279,196 A * 1/1994 Mohr ..... 414/907
5,488,886 A * 2/1996 Mohr ..... 83/282
5,695,313 A * 12/1997 Gross et al. ..... 414/788.9
5,784,940 A * 7/1998 Gross et al. ..... 83/640
6,132,348 A * 10/2000 Gross et al. ..... 483/13

FOREIGN PATENT DOCUMENTS

| | | |
|---|---|---|
| DE | 4206338 A1 | 9/1993 |
| DE | 4440754 C1 | 7/1996 |
| DE | 19629285 C1 | 2/1998 |
| GB | 566754 | 1/1945 |

* cited by examiner

*Primary Examiner*—Mark S. Graham
*Assistant Examiner*—Tom Duong
(74) *Attorney, Agent, or Firm*—Price, Heneveld, Cooper, DeWitt & Litton, LLP

(57) ABSTRACT

A machine for cutting stacked sheet material and like comprising a frame supporting the apparatus, and first and second guideways having first and second fixed guideway members mounted on the frame in a laterally spaced apart relationship, and first and second movable guideway members movably supported by the first and second fixed guideway members and oriented to shift vertically. A knife holder is connected with the first and second movable guideway members adjacent opposite sides thereof, and is configured to be shifted vertically. An actuator is operably connected between the frame and the knife holder for selectively shifting the knife holder vertically. A knife is connected with the knife holder, and includes an edge sharpened for cutting the sheet material when the knife holder is shifted vertically. A pivot bearing rotatably connects the knife holder with at least one of the first and second movable guideway members to facilitate cutting the sheet material.

24 Claims, 6 Drawing Sheets

MACHINE FOR CUTTING STACKED SHEET MATERIAL AND THE LIKE

BACKGROUND OF THE INVENTION

The present invention relates to devices for the cutting of stacked sheet material and the like, and in particular to a cutting machine having an improved mounting arrangement for the knife holder to reduce stresses during cutting, and provide an improved cut.

Sheet cutters are generally well known, as disclosed in DE 44 40 754 C1. In current sheet cutters, the respective linear guideway has a guide rail, in which a guiding carriage is guided, on the side of the holding rack. A pin, which swivels and is located in a drilled hole in the knife holder, is connected with the guiding carriage. A radial needle bearing surrounds the pin. An axial bearing is provided between the knife holder and a nut screwed into the pin's thread section; furthermore, an axial bearing is located between the guiding carriage and the knife holder. The large distance between the linear guideway's mounting plane and the knife holder's mounting plane in the pin is not advantageous for such cutters. As the mounting of the knife holder largely dictates the cutting level position of the knife held by the knife holder, the result is considerable distances between the cutting plane and the guide plane of the knife holder in the holding rack, whereby high bending moments are created as cutting is performed in the holding rack. In order to be able to withstand such high bending moments, the swivel bearing, as well as the linear guideway, must be closely dimensioned, which results in high construction and maintenance expenditures; further, considerable additional mass must be moved during the cut. Aside from this, the high bending moments created when cutting in the guiding carriage enclosing the guide rail cause the linear guideway to deform or widen. Imprecise guidance of the knife and cutting inaccuracy are the result.

Additional devices for the cutting of stacked sheet material having linear guideways mounted in roller bearing fashion for the knife holder are known from DE 42 06 338 A1 and DE 196 29 285 C1. A device for the cutting of stacked sheet material, which has a linear guideway mounted in a floating manner for the knife holder, is disclosed in GB 566 754.

SUMMARY OF THE INVENTION

It is the purpose of the present invention to obtain secure mounting of the knife holder in the holding rack, especially via the best possible mounting position of the knife holder, as well as the lowest possible bending moments, which are created by the knife's position in the holding rack during the cutting process.

This problem with the aforementioned type of device is solved by equipping the knife holder with a bearing element in the area of each respective linear guideway, which swivels and is located in a drilled hole on the guiding carriage.

It is essential that the bearing element, which is specifically made as a bolt or pin, is mounted in the guiding carriage in a pivoting or swiveling manner. Thereby the power contact point of the bearing element can be positioned as closely as desired in reference to the cutting plane. The bearing element's resulting power contact point is preferably selected in such a way that it coincides closely with the cutting plane. The result is a clearly directed, relatively small bending moment, which is transferred by the respective bearing element to the guiding carriage, during the cut. It is preferred that the position of the bearing element in the guiding carriage and the guiding carriage's position in the respective guide rail be essentially on one plane or level. Cutting forces are therefore transferred without significant bending moments from the knife and/or knife holder to the guiding carriage via the respective bearing element and from there into the respective guide rail. Based on the invention's design and arrangement of the aforementioned components, no distortion or widening of the bearing area is created, and no undefined clearance of the parts moving relatively towards each other can be found.

The guiding carriage's guided bearing can be achieved in different ways. There is, for example, the possibility of providing only one guide rail, into which the guiding carriage is mounted as an exact fit. It is also conceivable to provide two guide rails in the area of the respective linear guideway, which form a pair of guide rails, between which the guiding carriage is located, and in which it is guided. The pair of guide rails may form a unit and hence exhibit an essentially U-shaped cross section, whereby the guide rails are integrated into two shanks, and the unit is connected with the holding rack in the area of the web linking the two shanks.

For a useful design development of the invention, it is provided that the bearing element be securely or tightly connected with the knife holder. This secure connection may, for example, be achieved in that the bearing element, preferably using a bolt screwed into the knife holder.

According to a preferred design development, it is provided that the mounting of the bearing element be mounted in the guiding carriage in roller bearing fashion. This may be done by using axial and radial bearings, especially a needle bearing, in order to keep with a minimum profile or construction area for the bearing. The bearing element's axial and radial mounting in the guiding carriage, for example, is achieved with two separate pivot bearings, which are inserted into the guiding carriage and braced by screwing the bolt into the knife beam.

??According to this specific design, it is provided that the shorter guiding carriage located in the long guide rail, respectively?? the long guide rails have a relatively long length. It should correspond to at least half the length of the respective guide rail. It is therefore ensured that the guiding carriage can be guided in the guide rail, respectively guide rails, without tilting.

It is considered especially advantageous if the respective guide rail has an essentially M- or V-shaped cross section, and the guiding carriage's section facing the respective guide rail exhibits an essentially V-shaped cross section. Due to the co-actions of the respective cross sections, it is ensured that the guiding carriage is precisely guided in the respective guide rail on cutting line plane, respectively the plane running parallel to it, as well as vertically to this plane.

The guiding carriage's roller bearing in the guide rail, respectively the guide rails, may for example be done via a cage guided between them. With the co-actions of the M-shaped and V-shaped guide cross sections, the cage's cross section is preferably designed in V-shape. It may be designed as an angular flat cage, which takes a number of rolling elements. It is entirely conceivable to provide a rotary guide of rolling elements, especially a rotary roller guide, instead of a guide using a cage.

In order to be able to precisely align the knife holder with the bearing, respectively the holding rack, an eccentric tappet to adjust the bearing element relative to the knife holder should be provided at least in the area of one of the two knife holder bearings.

The knife holder can be operated in different ways, for example in one-sided or two-sided fashion. With a power source acting on two sides of the knife holder, the knife holder and associated linear guideways may be dimensioned less closely, as no strong forces may be initiated by the knife holder. The respective power source may for example be a hydraulic cylinder or an electric motor drive using a crank drive.

The way the knife holder is mounted in the holding rack according to the invention in that the linear guideway's symmetric plane (of the guiding carriage in the respective guide rail) and the rotary guide's symmetric plane (of the bearing bolt in the guiding carriage) essentially coincide, whereby the cutting plane should also be in the area of this plane, respectively these planes, is of special advantage.

Additional characteristics of the invention are demonstrated in the attached claims, as well as in the figure descriptions and the figures themselves.

BRIEF DESCRIPTION OF THE DRAWINGS

The illustrations show the invention by means of several preferred design examples of a guillotine cutter without being thereby limited.

DETAILED DESCRIPTION OF THE PREFERRED EMBODIMENTS

Figure 2:
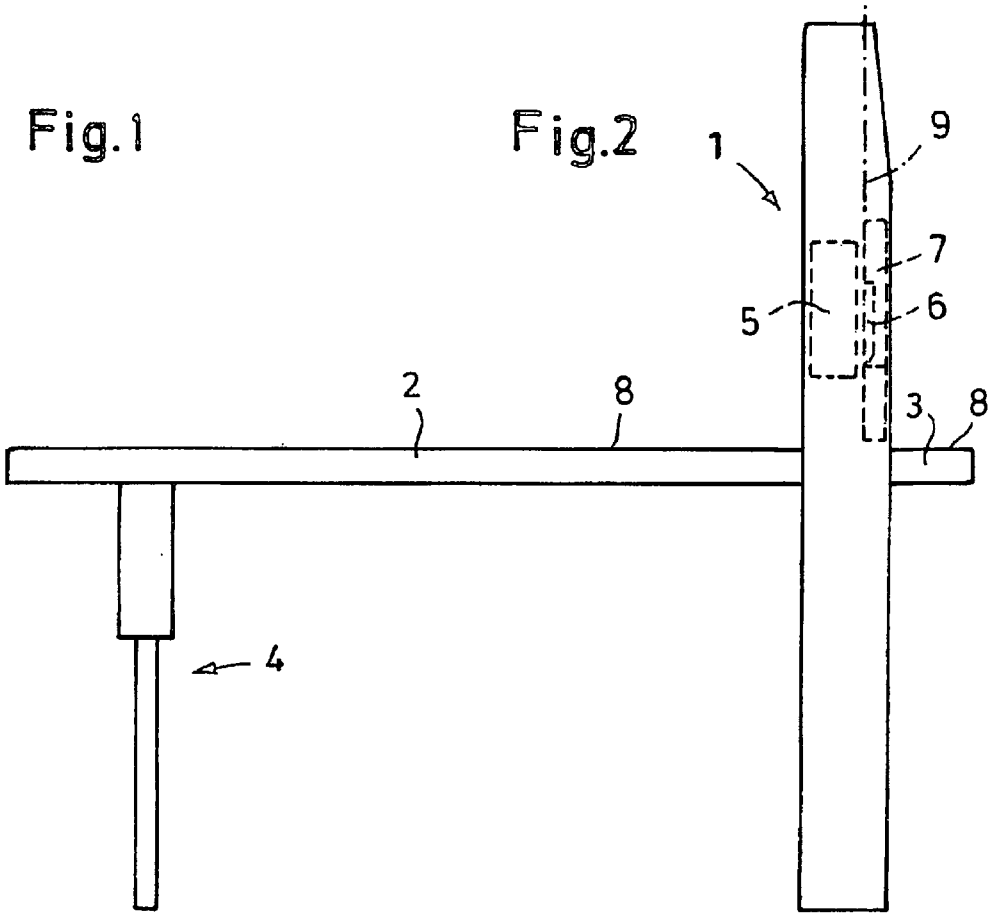
FIG. 2 is a side view of the cutter depicted in illustration 1 with components relevant to the invention shown in broken lines.
Figure 1:
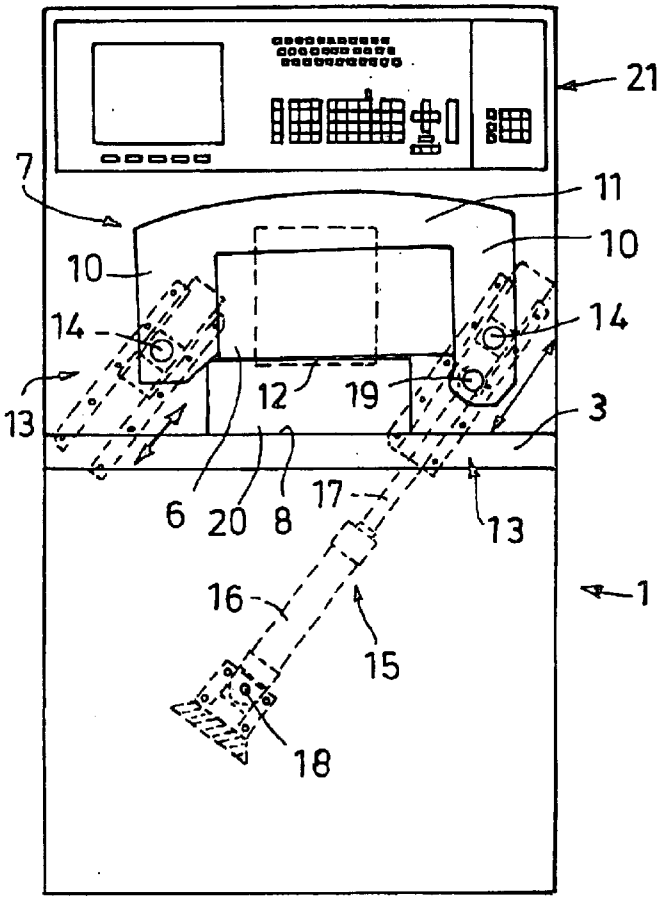
FIG. 1 is a front view of a cutter according to the invention with components relevant to the invention denoted with broken lines and referring to a first design example.
Figure 4:
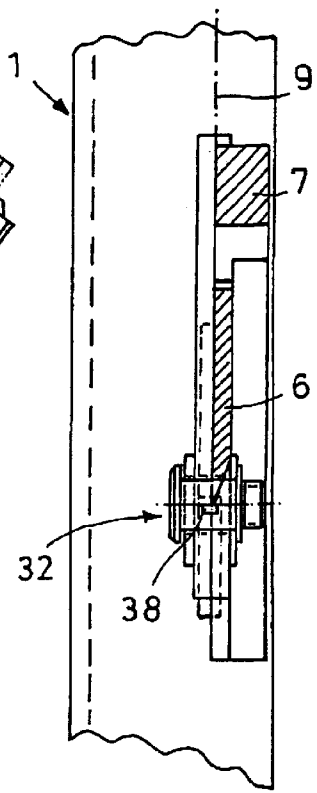
FIG. 4 is a cross-sectional view of the cutter, taken along the line B—B, FIG. 3.

The first design model of the cutter according to the invention is basically depicted in FIGS. 1 and 2 and is further illustrated in detail as it pertains to the knife holder's guide and seat area in the holding rack in FIGS. 3 to 6.

The cutter has a frame or stand 1, a back table 2 to hold the material to be cut, as well as a front table 3 to hold the material which has been cut. The material to be cut is, for example, a stack in large format, which consists of a number of sheets of paper or the like lying on top of each other. Back table 2 is supported in its back area by a leg or support 4. Above tables 2 and 3 in stand 1 is a press beam 5 mounted to compress or retain the material to be cut prior to cutting, and a knife 6 mounted in front of press beam 5 to sever or separate the material to be cut. Knife 6 is detachably retained in stand 1, i.e., knife 6 is tightly screwed into a knife holder 7, which is mounted in stand 1 in moveable fashion. The cutting plane running vertical to bearing or support surface 8 of tables 2 and 3 is shown with a broken line 9. Knife holder 7 has an inverted U-shaped configuration comprising vertically oriented shanks 10, as well as a web 11 being connected and oriented essentially horizontally. As can be seen in FIG. 1, knife holder 7 is arranged with its shanks 10 and web 11 in a slightly cocked position, i.e., tilted from the horizontal, such that knife 6 with its cutting edge 12 is also arranged slightly tilted to the horizontal. As knife 6 is lowered, cutting edge 12 is rotated or oscillated until it encounters a horizontally arranged cutting strip 38 mounted in table surface 8, whereby cutting edge 12 is positioned parallel to table surface 8. In order to achieve this rotating or oscillating cut, knife holder 7 is moved in linear guideways, which are arranged at different angles, back and forth in the direction of the two double arrows shown in FIG. 1. Knife holder 7 swivels around axes 14 relative to linear guideways 13. Knife 6 and knife holder 7 are operated by an actuator, which in the illustrated example, is a hydraulic cylinder 15 acting on the lower extended end of the right hand shank 10 of knife holder 7, with cylinder sleeve 16 being connected with stand 1 in below swiveling fashion, and piston rod 17 being connected with the right hand shank 10 of knife holder 7 in above swiveling fashion. The swivel axes are each denoted by the reference numbers 18 and 19. The direction of force and travel of hydraulic cylinder 15 is oriented in essentially longitudinal direction of linear guideway 13, located at its point of contact on knife holder 7.

In stand 1, beneath raised knife 6, an opening 20 is provided to receive therein the material to be cut. Above knife holder 7, the front of stand 1 is equipped with a control panel 21.

The construction according to the invention and the functionality of the knife holder seated in stand 1 is illustrated in illustrations 3 to 6 wherein the knife holder is shown in its lower end position, and the knife is shown in its lower end position.

As the mounting of knife holder 7 is similar in both the left and right hand linear guideways 13, and linear guideways 13 are different only as to their angle or slant to the vertical, in order to achieve a rotating or oscillating cut, the following only describes the mounting of the left hand end of knife holder 7 in stand 1, as related to the orientation of the drawing. Therefore the same description also applies to the mounting of the right hand end of knife holder 7 in stand 1.

Figure 3:
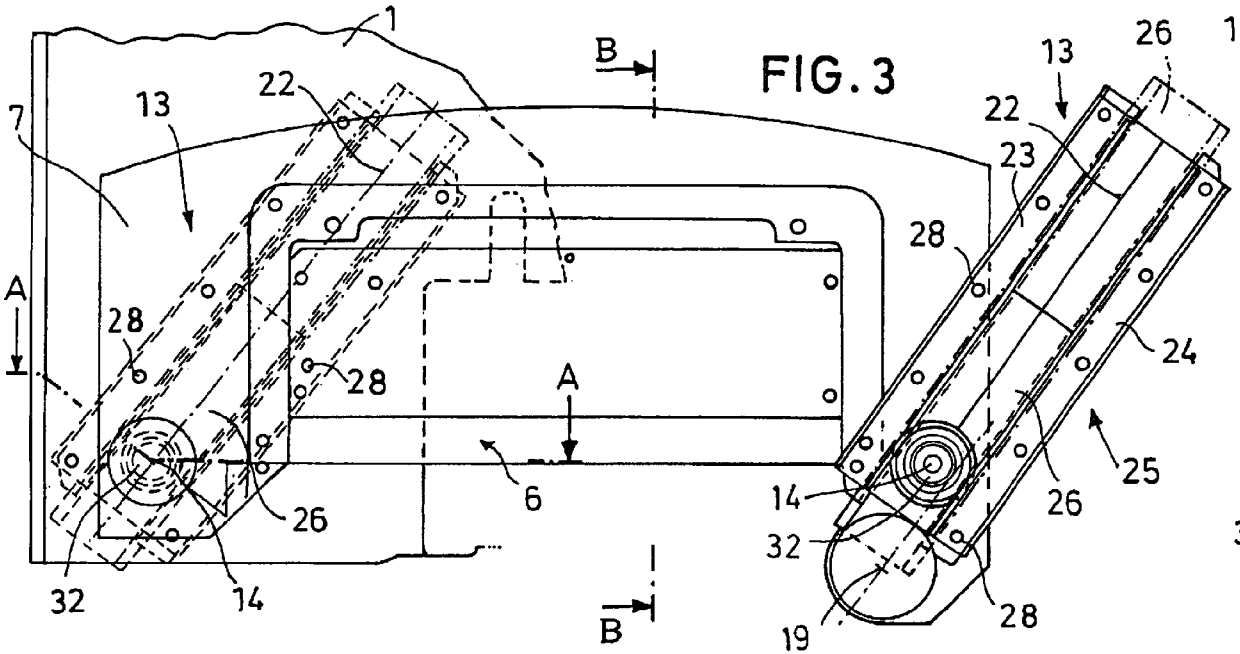
FIG. 3 is an enlarged depiction of the cutter's area relevant to the invention shown in illustration 1, in front view.
Figure 5:
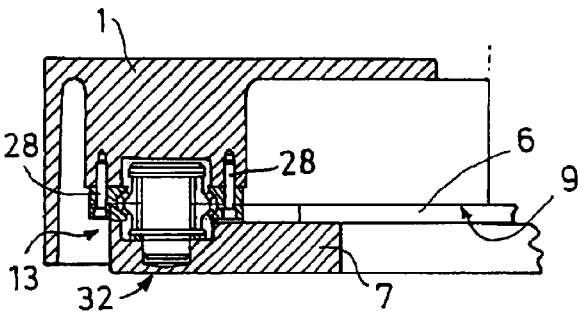
FIG. 5 is a cross-sectional view of the cutter, taken along the line A—A, FIG. 3.

In the illustrated example, linear guideway 13 (FIGS. 3–5) has its longitudinal axis 22 arranged at a predefined angle to the horizontal, which is preferably 40 degrees to 60 degrees, especially 50 degrees, so that knife 6 cuts across the sheets at an angle. Linear guideway 13 includes a pair of outer guide rails 25, which are defined by guide rails 23 and 24 arranged parallel to each other, as well as guiding carriage 26 located between them and guided by them. The length of guiding carriage 26, as shown in FIG. 3, is slightly longer than half the length of outer rail pair 25. Guide rails 23 and 24 of rail pair 25 are designed as so-called M-guide rails, i.e., they have an essentially M-shaped lateral cross section. The V-shaped bearing surfaces of guide rails 23 and 24 are denoted by the reference number 27. Guide rails 23 and 24 are connected to stand 1 by a plurality of screws 28. Guiding carriage 26 has on its sides, which are oriented towards guide rails 23 and 24, V-shaped bearing surfaces 29, whereby the angle formed between them coincides with the angle of bearing surface 27 of M-guide rails 23 and 24 respectively. Guiding carriage 26 is designed as a double V-rail. Guiding carriage 26 is located at a spaced apart distance from guide rail pair 25, whereby the space formed between each guiding carriage 26 and guide rails 23 and 24 serves to accept a flat needle roller cage 30 (FIG. 6), which is arranged in V-shape and shifted by a power source. The shifting or translation of each needle roller flat cage 30 relative to guiding carriage 26 and associated guide rail 23, respectively 24, can be achieved in different ways and is therefore not depicted in the illustrations in further detail. Concretely, the guiding carriage's mounting according to the invention in guide rail pair 25 in accordance with the invention at hand may be realized via a flat cage guide by using HYDRL/EGIS M- and V-guide rails with integrated gear rack to guide an angular needle roller flat cage having a pinion as per the catalog of HYDRL AG/INA LINERTZ-Technik OHG, article code 005-276-373/FRF-D-D-049915, pages 62 to 64. The dimensions of needle roller flat cage 30's length are such that precise, clearance-free guidance of guiding carriage 26 in guide rails 23 and 24 is ensured when moving guiding carriage 26 from its lower end position demonstrated in FIG. 3 into its upper end position also demonstrated in this illustration with broken lines.

Figure 6:
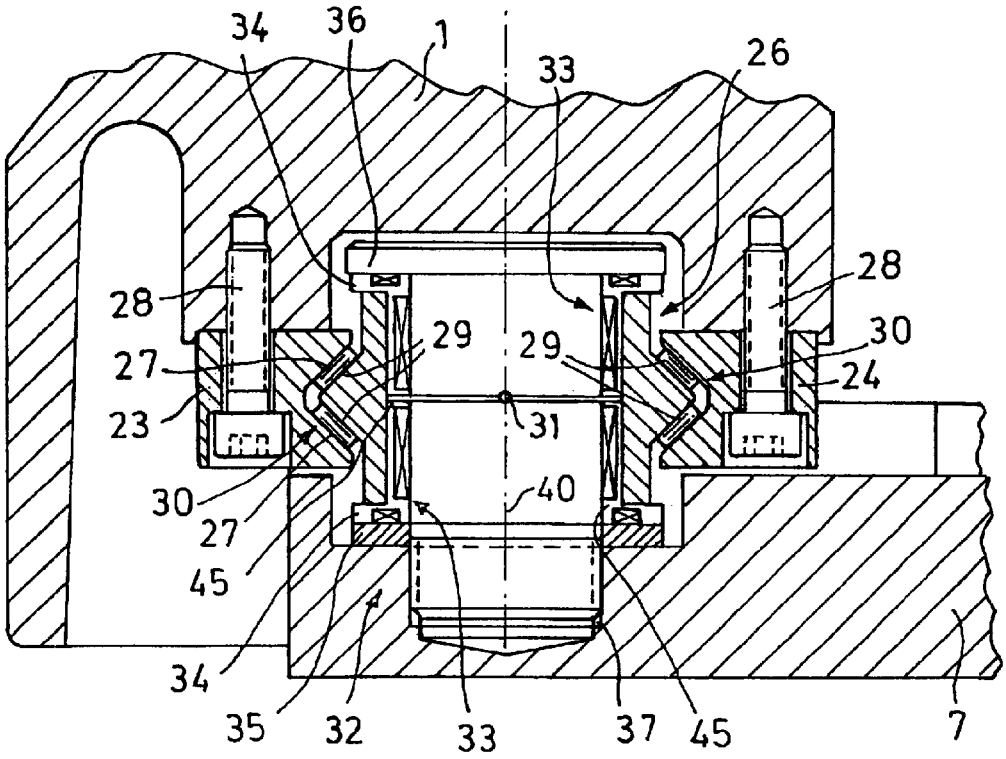
FIG. 6 is an enlarged view of the connection of knife holder and component of the cutter's holding rack creating the stand.

As can be seen especially from the depiction in FIG. 6, guide rail pair 25 and guiding carriage 26, and especially their V-shaped bearing surfaces 27 and 29, are designed symmetrically, whereby these components are mounted relative to stand 1 in such a way that the symmetrical axis essentially coincides with cutting plane 9. Resulting power contact point 31 of the bearing for knife holder 7 in guiding carriage 26 also essentially coincides with cutting plane 9. Knife holder 27 is mounted in each linear guideway 13 with a pin or threaded bolt 32, which extends through two pivot bearings or radial axial bearings 33 inserted into drilled hole 45 of guiding carriage 26. The two pivot bearings 33 are designed as needle bearings, whereby their front ring shoulders 34 are affixed between guiding carriage 26 and washer 35, abutting to the knife holder, respectively between guiding carriage 6 and head section 36 of threaded bolt 32. This threaded bolt 32 is screwed into tapped hole 37 of knife holder 7 from the back area of stand 1. In order to be able to screw in threaded bolt 32, stand 1 is equipped with a drilled hole for example, so that a screwing tool can be inserted.

Figure 7:
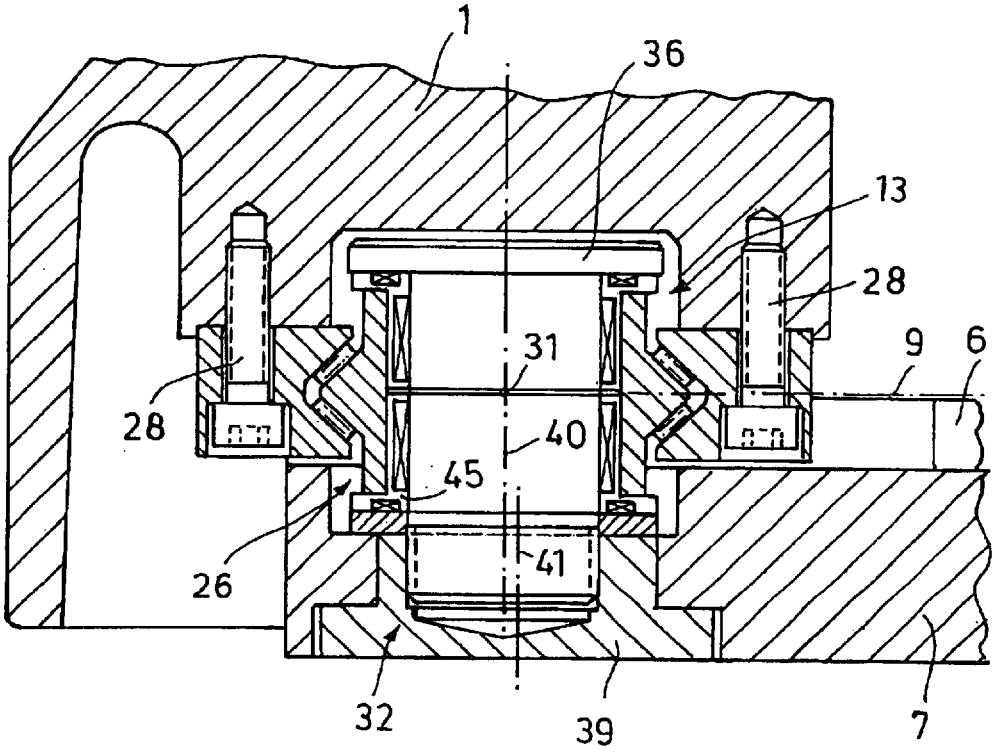
FIG. 7 is a slightly modified design of the knife holder's guide and seat area compared to the design shown in FIG. 6.
Figure 8:
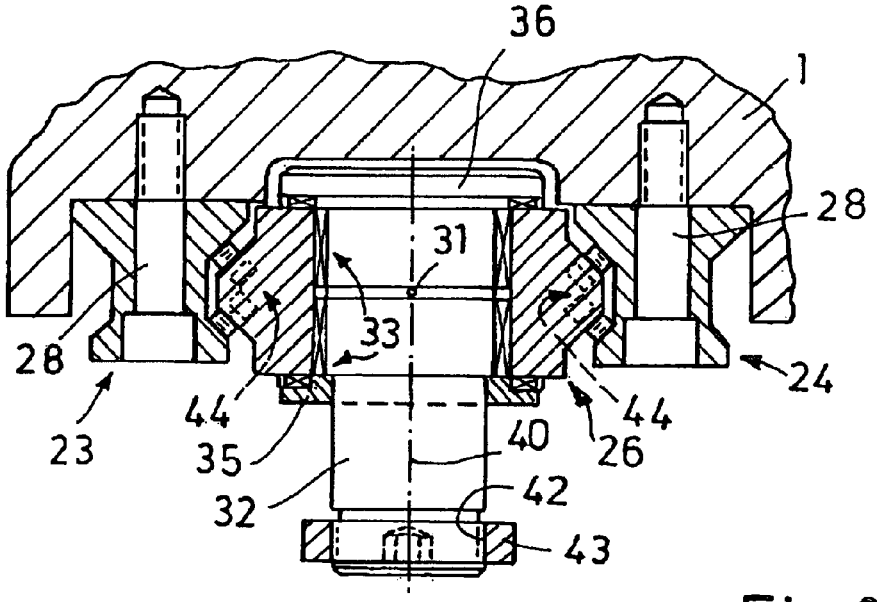
FIGS. 8 to 11 illustrate modified design examples of the knife holder's guide and seat area in the holding rack, illustrated in sectional view similar to FIG. 6.
Figure 9:
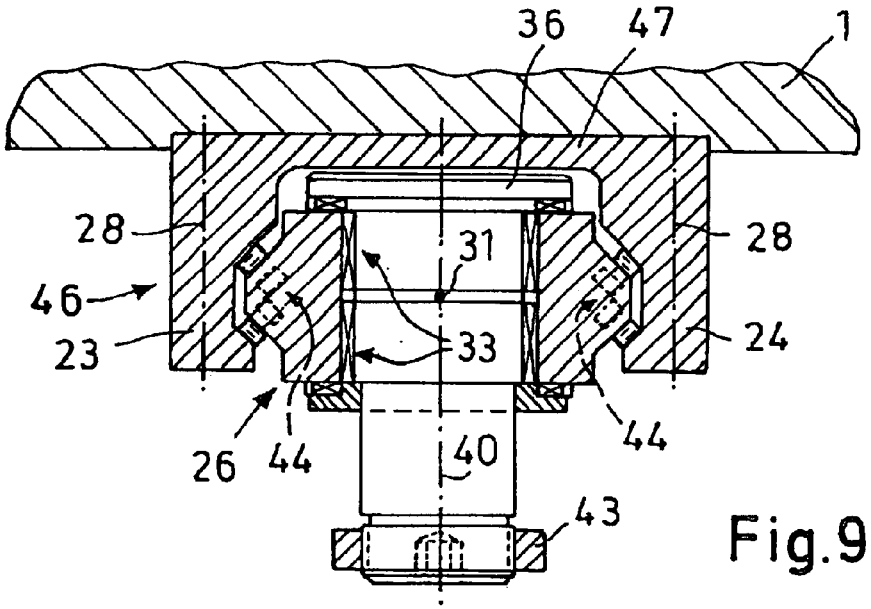
Figure 10:
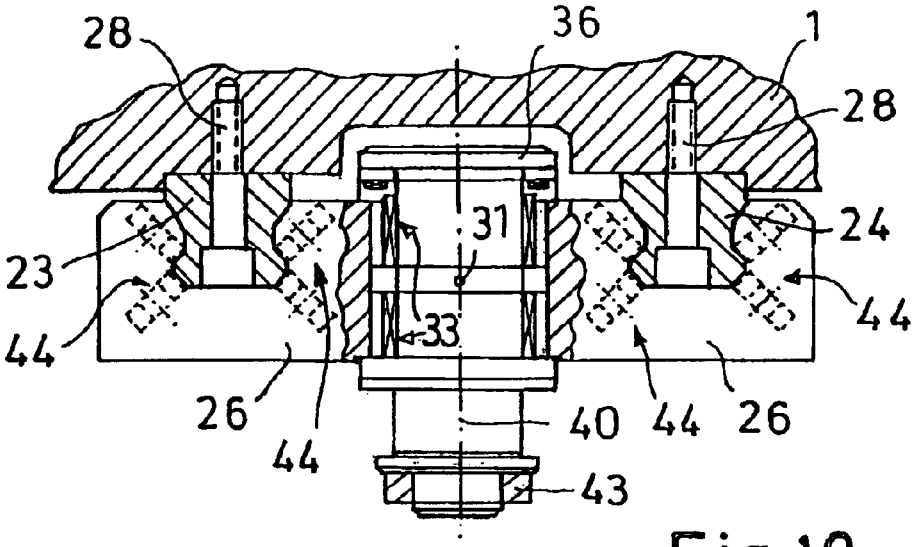

FIG. 7 shows a slightly modified design of the mounting of the respective threaded bolt 32 in knife holder 7 compared to the design example according to FIG. 6. To change the position of knife 6, respectively knife holder 7 relative to stand 1 in order to adjust the cutting edge's position of knife 6 in the lower dead center relative to cutting strip 38, at least one of the two threaded bolts 32 is screwed into knife holder 7 not directly, but into eccentric tappet holder 39, which is mounted eccentrically to mid-longitudinal axis 40 of threaded bolt 32 in a cavity, which has a shoulder and is concentric relative to axis 41, in knife holder 7. This eccentric tappet holder 39 swivels relative to knife holder 7, and eccentric tappet holder 39 and knife holder 7 can be connected in the adjusted position in the area of the broken lines via means not illustrated.

Figure 11:
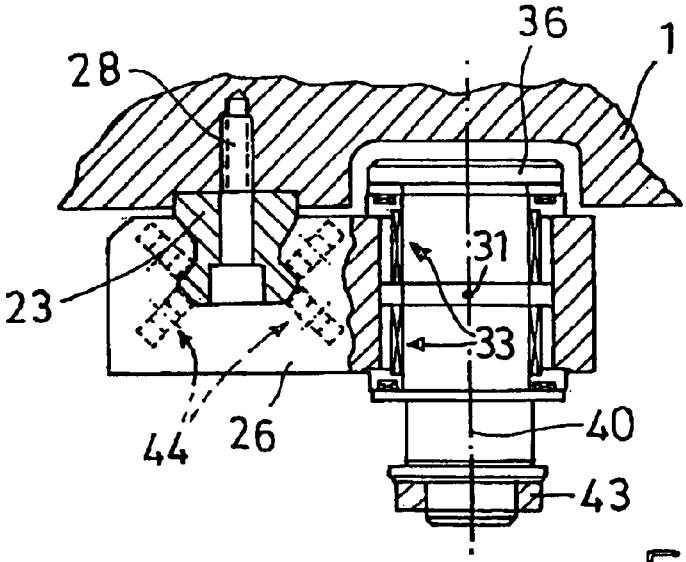

FIGS. 8 to 11 show the cutter's modified design compared to the design examples in the respective sections of FIGS. 6 and 7. In the drawings of these illustrations, however, knife holder 7 was dispensed with; therefore it is especially referred to the depiction in FIG. 7. In the design examples according to FIGS. 8 to 11, knife holder 7 is not mounted with a threaded blind hole 37, into which threaded bolt 32 is screwed, as shown in FIG. 6. Instead, knife holder 7 is equipped with a clearance hole, which is put through threaded bolt 32. Nut 43 is screwed into its thread section 42, comparable to eccentric tappet holder 39, whereby nut 43 holds knife holder 7 against washer 35. Other design examples of linear guideways 13 are being illustrated in FIGS. 8 to 11. Instead of mounting guiding carriage 32 in guide rails 23 and 24 via guided cage 30 between them, these modifications show guidance via a rotary roller guide, which is generally denoted by the reference number 44. The design example according to FIG. 2 provides for two outer guide rails 23 and 24, which hold guiding carriage 26 between them. Guide rails 23 and 24 form separate components, which are screwed into stand 1. In the design example according to FIG. 9, the two guide rails 23 and 24 form unit 46 with a U-shaped cross section, which is screwed into stand 1 in the area of web 47, which connects its two shanks with each other. Screws 28 extend through the two shanks of unit 46, into which guide rails 23 and 24 are integrated. Also, in this design example, guiding carriage 26 is arranged within the space formed between the two guide rails 23 and 24. In the design example according to FIG. 10, the design of guide rails 23 and 24 is developed as per those in FIG. 8, however, guiding carriage 26 is designed in such a way that it is developed in plate shape and guide rails 23 and 24 are herewith embedded into guiding carriage 26. Rotary roller guides 44 are therefore located on both sides of guide rail 23, respectively 24, as relative to each guide rail 23, respectively 24. The design example according to FIG. 11 is distinguished from the one in FIG. 10 in that guiding carriage 26 is seated only in the area of one guide rail, guide rail 23. Guide rail 24 and the plate area of guiding carriage 26 in the area of this guide rail are therefore omitted.

The invention claimed is as follows:

1. An apparatus for cutting stacked sheet material and the like, comprising:

a frame supporting said apparatus;

first and second guideways having first and second fixed guideway members mounted on said frame in a laterally spaced apart relationship, and first and second movable guiding carriages movably supported by said first and second fixed guideway members and oriented to shift vertically; at least one of said first and second movable guiding carriages includes a mounting hole therein;

a knife holder connected with said first and second movable guiding carriages adjacent opposite sides thereof, and configured to be shifted vertically;

an actuator operably connected between said frame and said knife holder for selectively shifting said knife holder vertically;

a knife connected with said knife holder and having an edge shaped for cutting the sheet material when said knife holder is shifted vertically; and a pivot bearing mounted in said mounting hole, rotatably connecting said knife holder with said one of said first and second movable guiding carriages to facilitate cutting the sheet material, and including a roller bearing.

2. An apparatus as set forth in claim 1, wherein:

said pivot bearing includes a pin mounted in said knife holder and extending laterally therefrom.

3. An apparatus as set forth in claim 2, wherein:

said first and second fixed guideway members each comprise first and second guide rails which are spaced laterally apart in a parallel relationship; and said first and second moveable guiding carriages are positioned between said first and second guide rails.

4. An apparatus as set forth in claim 3, wherein:

said first and second guide rails are a unitary structure with a U-shaped cross-sectional configuration.

5. An apparatus as set forth in claim 4, wherein:

said pin comprises a bolt having a threaded end thereof screwed into a mating threaded aperture in said knife holder.

6. An apparatus as set forth in claim 5, wherein:

said pivot bearing and said guiding carriage are disposed in a common plane located generally commensurate with the cutting plane of said knife.

7. An apparatus as set forth in claim 6, wherein:

said actuator is connected with said knife holder at a location adjacent to the cutting plane of said knife.

8. An apparatus as set forth in claim 7, wherein:

said roller bearing is mounted in said guiding carriage.

9. An apparatus as set forth in claim 8, wherein:

said first and second guideways each have a generally V-shaped portion in lateral cross section arranged in an opposing relationship.

10. An apparatus as set forth in claim 9, wherein:

said roller bearing includes a roller cage disposed between said guide rails and said guiding carriage.

11. An apparatus as set forth in claim 10, wherein:

said roller bearing includes a rotary roller guide.

12. An apparatus as set forth in claim 11, including:

an eccentric tappet for adjusting said pivot bearing relative to said knife holder.

13. An apparatus as set forth in claim 12, wherein:

said pin comprises a bolt having a threaded end thereof screwed into a mating threaded aperture in said knife holder.

14. An apparatus as set forth in claim 1, wherein:

said first and second fixed guideway members each comprise first and second guide rails which are spaced laterally apart in a parallel relationship; and said first and second moveable guiding carriages are positioned between said first and second guide rails.

15. An apparatus as set forth in claim 14, wherein:

said first and second guide rails are a unitary structure with a U-shaped cross-sectional configuration.

16. An apparatus as set forth in claim 1, wherein:

said pivot bearing is disposed in a plane located generally commensurate with the cutting plane of said knife.

17. An apparatus as set forth in claim 1, wherein:

said actuator is connected with said knife holder at a location adjacent to the cutting plane of said knife.

18. An apparatus as set forth in claim 1, wherein:

said first and second guideways each have a generally V-shaped portion in lateral cross section arranged in an opposing relationship.

19. An apparatus as set forth in claim 1, wherein:

said roller bearing includes roller cages disposed between said fixed guideway members and said movable guiding carriages.

20. An apparatus as set forth in claim 1, wherein:

said roller bearing includes a rotary roller guide.

21. An apparatus as set forth in claim 1, including:

an eccentric tappet for adjusting said pivot bearing relative to said knife holder.

22. An apparatus for cutting stacked sheet material and the like, comprising:

a frame supporting said apparatus;

first and second guideways having first and second fixed guideway members mounted on said frame in a laterally spaced apart relationship, and first and second movable guiding carriages movably supported by said first and second fixed guideway members and oriented to shift vertically; at least one of said first and second movable guiding carriages includes a mounting hole therein;

a knife holder connected with said first and second movable guiding carriages adjacent opposite sides thereof, and configured to be shifted vertically;

an actuator operably connected between said frame and said knife holder for selectively shifting said knife holder vertically;

a knife connected with said knife holder and having an edge shaped for cutting the sheet material when said knife holder is shifted vertically; and a pivot bearing mounted in said mounting hole, rotatably connecting said knife holder with said one of said first and second movable guiding carriages to facilitate cutting the sheet material, and including roller cages disposed between said fixed guideway members and said movable guideway members.

23. An apparatus for cutting stacked sheet material and the like, comprising:

a frame supporting said apparatus;

first and second guideways having first and second fixed guideway members mounted on said frame in a laterally spaced apart relationship, and first and second movable guiding carriages movably supported by said first and second fixed guideway members and oriented to shift vertically; at least one of said first and second movable guiding carriages includes a mounting hole therein;

a knife holder connected with said first and second movable guiding carriages adjacent opposite sides thereof, and configured to be shifted vertically;

an actuator operably connected between said frame and said knife holder for selectively shifting said knife holder vertically;

a knife connected with said knife holder and having an edge shaped for cutting the sheet material when said knife holder is shifted vertically; and a pivot bearing mounted in said mounting hole, rotatably connecting said knife holder with said one of said first and second movable guiding carriages to facilitate cutting the sheet material, and including a rotary roller guide.

24. An apparatus for cutting stacked sheet material and the like, comprising:

a frame supporting said apparatus;

first and second guideways having first and second fixed guideway members mounted on said frame in a laterally spaced apart relationship, and first and second movable guiding carriages movably supported by said first and second fixed guideway members and oriented to shift vertically; at least one of said first and second movable guiding carriages includes a mounting hole therein;

a knife holder connected with said first and second movable guiding carriages adjacent opposite sides thereof, and configured to be shifted vertically;

an actuator operably connected between said frame and said knife holder for selectively shifting said knife holder vertically;

a knife connected with said knife holder and having an edge shaped for cutting the sheet material when said knife holder is shifted vertically; and a pivot bearing mounted in said mounting hole, rotatably connecting said knife holder with said one of said first and second movable guiding carriages to facilitate cutting the sheet material, and including an eccentric tappet for adjusting said pivot bearing relative to said knife holder.

* * * * *